US009707772B2

(12) United States Patent
Nishiyama

(10) Patent No.: US 9,707,772 B2
(45) Date of Patent: Jul. 18, 2017

(54) INK CIRCULATION TYPE INKJET PRINTER

(71) Applicant: RISO KAGAKU CORPORATION, Tokyo (JP)

(72) Inventor: Akira Nishiyama, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/858,406

(22) Filed: Sep. 18, 2015

(65) Prior Publication Data

US 2016/0089896 A1 Mar. 31, 2016

(30) Foreign Application Priority Data

Sep. 29, 2014 (JP) ..... 2014-198742

(51) Int. Cl.
*B41J 2/175* (2006.01)
*B41J 2/18* (2006.01)

(52) U.S. Cl.
CPC ..... *B41J 2/17596* (2013.01); *B41J 2/175* (2013.01); *B41J 2/17556* (2013.01); *B41J 2/17566* (2013.01); *B41J 2/18* (2013.01)

(58) Field of Classification Search
CPC ..... B41J 2/18
USPC ..... 347/89, 90
See application file for complete search history.

(56) References Cited

U.S. PATENT DOCUMENTS 7,597,434 B2 * 10/2009 Nitta ..... B41J 2/175 347/7
7,845,784 B2 * 12/2010 Nitta ..... B41J 2/175 347/89
8,109,613 B2 * 2/2012 Nitta ..... B41J 2/175 347/59
8,132,902 B2 * 3/2012 Shibata ..... B41J 2/17509 347/89
8,197,046 B2 * 6/2012 Asami ..... B41J 2/175 347/89
8,403,439 B2 * 3/2013 Tanaka ..... B41J 2/175 347/17
8,449,087 B2 * 5/2013 Kataoka ..... B41J 2/18 347/84

(Continued)

FOREIGN PATENT DOCUMENTS

JP 2012-153004 8/2012

*Primary Examiner* — Matthew Luu
*Assistant Examiner* — Lily Kemathe
(74) *Attorney, Agent, or Firm* — Greenblum & Bernstein, P.L.C.

(57) ABSTRACT

An inkjet printer includes: a positive pressure space for a positive pressure for circulating ink along a circulation path to be applied; a negative pressure space for a negative pressure for circulating the ink along the circulation path to be applied; a positive-pressure-side air opening valve configured to selectively open and close the positive pressure space to a positive-pressure-side air opening path; a negative-pressure-side air opening valve configured to selectively open and close the negative pressure space to a negative-pressure-side air opening path; and a control unit configured to, when terminating circulation of the ink in the circulation path, drive the positive-pressure-side air opening valve to open the positive pressure space to the positive-pressure-side air opening path and then drive the negative-pressure-side air opening valve to open the negative pressure space to the negative-pressure-side air opening path.

6 Claims, 6 Drawing Sheets

(56) References Cited

U.S. PATENT DOCUMENTS 8,500,256 B2 * 8/2013 Nitta ..... B41J 2/175 347/85
8,641,179 B2 * 2/2014 Kuribayashi ..... B41J 2/175 347/19
8,721,058 B2 * 5/2014 Nitta ..... B41J 2/175 347/85
8,899,171 B2 * 12/2014 Mauck ..... B41J 29/393 118/300
9,102,157 B2 * 8/2015 Prothon ..... B41J 2/175
9,102,163 B2 * 8/2015 Shibata ..... B41J 2/19
9,242,475 B2 * 1/2016 Otsuka ..... B41J 2/17596
9,272,524 B1 * 3/2016 Sugitani ..... B41J 2/17596
9,327,514 B2 * 5/2016 Nishiyama ..... B41J 2/17596
9,340,031 B2 * 5/2016 Sugitani ..... B41J 2/17596
9,365,045 B2 * 6/2016 Shibata ..... B41J 2/175
9,365,046 B2 * 6/2016 Sugitani ..... B41J 2/17596
2007/0252860 A1 * 11/2007 Nitta ..... B41J 2/175 347/14
2008/0158307 A1 * 7/2008 Nitta ..... B41J 2/17596 347/85
2009/0051722 A1 * 2/2009 Kaiho ..... B41J 29/38 347/17
2009/0295881 A1 * 12/2009 Tasaka ..... B41J 2/1707 347/85
2010/0247769 A1 * 9/2010 Ooishi ..... B41J 2/175 427/256
2011/0050794 A1 * 3/2011 Koike ..... B41J 2/125 347/22
2011/0279495 A1 * 11/2011 Kuribayashi ..... B41J 2/175 347/6
2012/0033003 A1 * 2/2012 Tanaka ..... B41J 2/175 347/6
2012/0188314 A1 * 7/2012 Akiyama ..... B41J 2/175 347/85
2013/0293604 A1 * 11/2013 Nitta ..... B41J 2/175 347/6

* cited by examiner

| | | NEGATIVE PRESSURE TANK LIQUID LEVEL SENSOR | |
|---|---|---|---|
| | | ON | OFF |
| POSITIVE PRESSURE TANK LIQUID LEVEL SENSOR | ON | INK PUMP: OFF<br>INK SUPPLY VALVE: CLOSED | INK PUMP: OFF<br>INK SUPPLY VALVE: CLOSED |
| | OFF | INK PUMP: ON<br>INK SUPPLY VALVE: CLOSED | INK PUMP: OFF<br>INK SUPPLY VALVE: OPENED |

INK CIRCULATION TYPE INKJET PRINTER

CROSS REFERENCE TO RELATED APPLICATION

This application is based upon and claims the benefit of priority from the prior Japanese Patent Application No. 2014-198742, filed on Sep. 29, 2014, the entire contents of which are incorporated herein by reference.

BACKGROUND

1. Technical Field

The disclosure relates to an ink circulation type inkjet printer.

2. Related Art

There is known an ink circulation type inkjet printer that performs printing by ejecting ink from an inkjet head while circulating the ink.

Japanese Unexamined Patent Application Publication No. 2012-153004 describes an ink circulation type inkjet printer having ink tanks provided upstream and downstream of an inkjet head, and disposed at positions lower than the inkjet head.

When performing printing, such an inkjet printer hermetically seals both the ink tanks by closing air open valves connected to the respective ink tanks. Then, the printer applies a positive pressure to a positive pressure tank that is an ink tank located upstream, and applies a negative pressure to a negative pressure tank that is an ink tank located downstream. Thus, ink flows from the positive pressure tank to the inkjet head. The ink, which is not consumed by the inkjet head, is collected by the negative pressure tank. An air pump delivers the ink from the negative pressure tank to the positive pressure tank. In this manner, the ink is circulated.

When the printing is completed, the air open valves connected to the ink tanks are opened. Thus, the pressures of both the ink tanks change to the atmospheric pressure. Consequently, the circulation of the ink is terminated.

SUMMARY

In the above-described inkjet printer, after the air open valves are opened in order to terminate the circulation of ink, the pressure of the positive pressure tank gradually decreases, whereas the pressure of the negative pressure tank gradually increases, so that both the pressures change to the atmospheric pressure. In this process, a nozzle pressure of the inkjet head also changes according to the changes in the pressures of the positive pressure tank and the negative pressure tank. This change in the nozzle pressure may cause leakage of the ink through a nozzle.

The disclosure aims to provide an inkjet printer that is capable of reducing leakage of ink through a nozzle of the inkjet head.

An inkjet printer in accordance with some embodiments includes: a printing unit with a circulation path and an inkjet head, the printing unit being configured to eject ink through a nozzle of the inkjet head while circulating the ink along the circulation path; a positive pressure space for a positive pressure for circulating the ink along the circulation path to be applied; a negative pressure space for a negative pressure for circulating the ink along the circulation path to be applied; a positive-pressure-side air opening path having one end connected to the positive pressure space and another end communicating with atmosphere; a negative-pressure-side air opening path having one end connected to the negative pressure space and another end communicating with the atmosphere; a positive-pressure-side air opening valve configured to selectively open and close the positive pressure space to the positive-pressure-side air opening path; a negative-pressure-side air opening valve configured to selectively open and close the negative pressure space to the negative-pressure-side air opening path; and a control unit configured to, when terminating circulation of the ink in the circulation path, drive the positive-pressure-side air opening valve to open the positive pressure space to the positive-pressure-side air opening path and then drive the negative-pressure-side air opening valve to open the negative pressure space to the negative-pressure-side air opening path, thereby opening the positive pressure space and the negative pressure space to the atmosphere.

With the above-described configuration, it is possible to reduce leakage of ink through a nozzle by setting the nozzle pressure to a negative pressure when opening the positive pressure space and the negative pressure space to the atmosphere.

The controller may be configured to determine a time from opening of the positive pressure space to the positive-pressure-side air opening path to opening of the negative pressure space to the negative-pressure-side air opening path, based on a flow path resistance of the positive-pressure-side air opening path and an air capacity of the positive pressure space.

With the above-described configuration, it is possible to avoid a situation in which excessive decrease in the nozzle pressure causes meniscus to be broken and air to be sucked through a nozzle.

DETAILED DESCRIPTION

Figure 1:
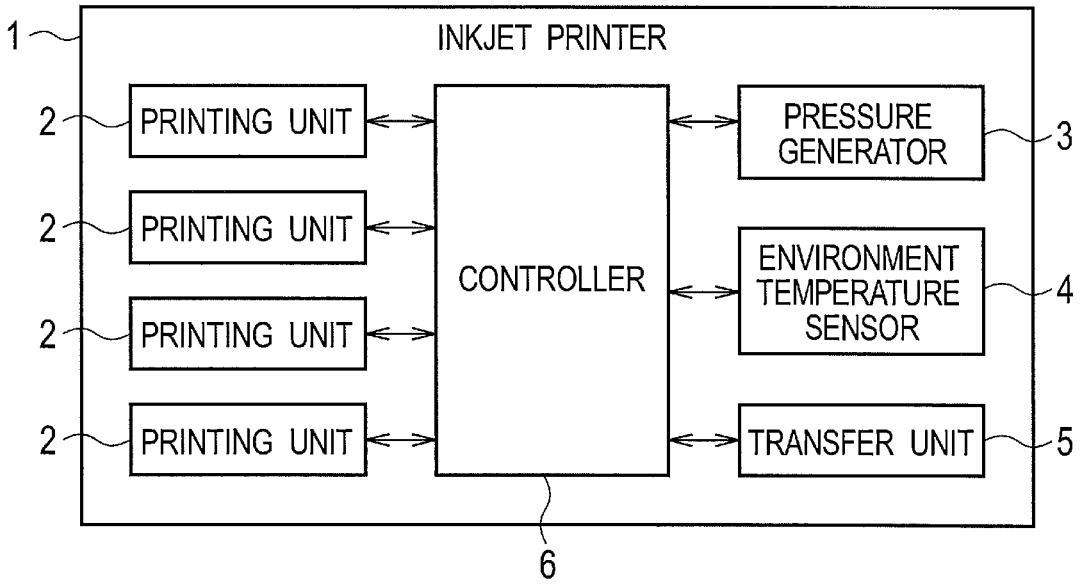
FIG. 1 is a block diagram illustrating a configuration of an inkjet printer according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

As illustrated in FIG. 1, an inkjet printer 1 according to the present embodiment includes four printing units 2, a pressure generation unit 3, an ambient temperature sensor 4, a transfer unit 5, and a controller 6.

Each of the printing units 2 ejects ink onto a sheet of paper to print an image while circulating ink, the sheet of paper being transferred by the transfer unit 5. The four printing units 2 eject ink of different colors (for instance, black, cyan, magenta, yellow). The four printing units 2 have the same configuration except that the colors of ink to be ejected are different.

Figure 2:
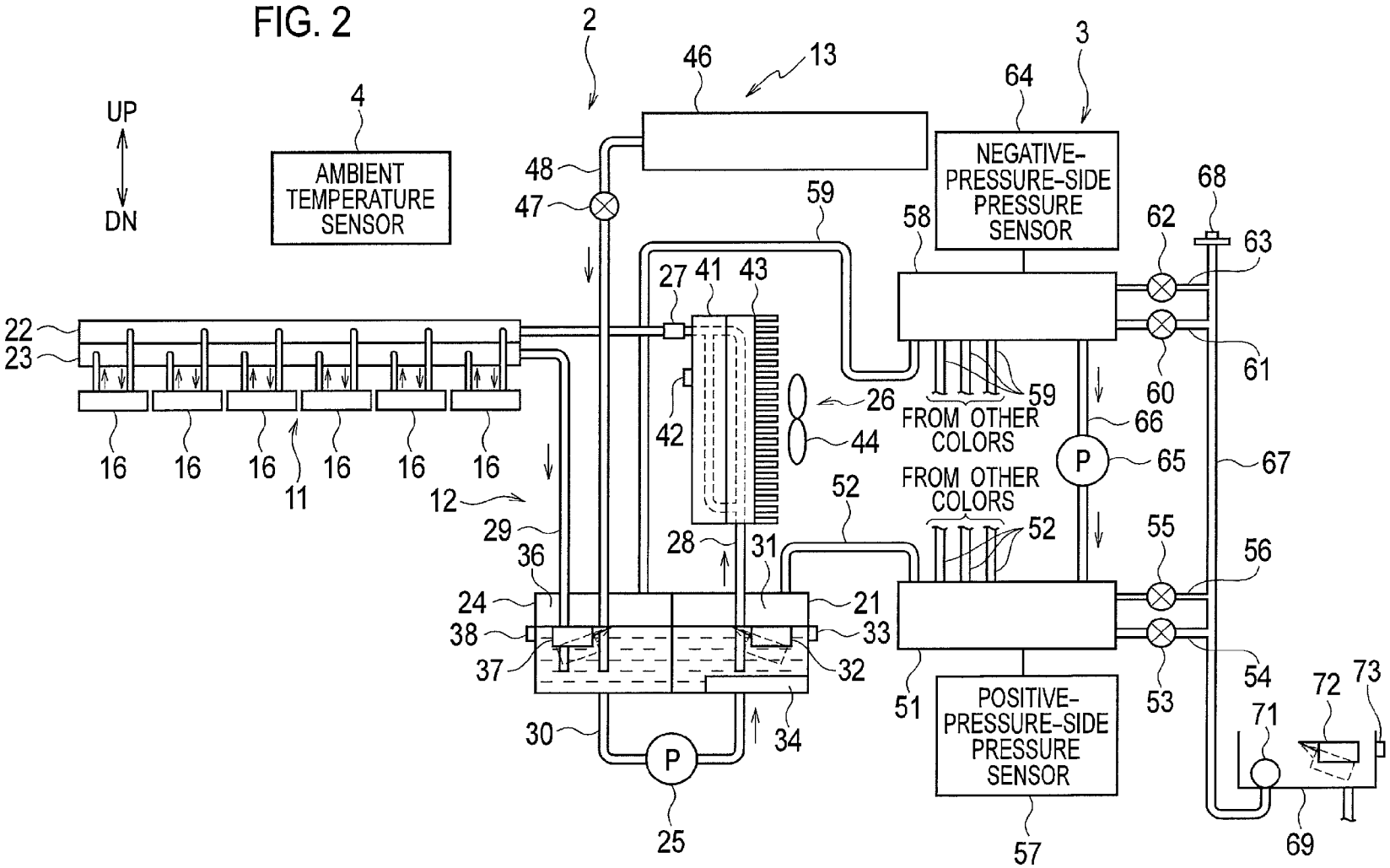
FIG. 2 is a schematic configuration diagram of printing units and a pressure applying unit of the inkjet printer illustrated in FIG. 1.

As illustrated in FIG. 2, each of the printing units 2 includes an inkjet head 11, an ink circulation unit 12 and an ink supply unit 13. It is to be noted that the upward and downward directions in the following description indicate the vertical direction and in FIG. 2, UP indicates the upward direction and DN indicates the downward direction.

The inkjet head 11 ejects ink which is supplied by the ink circulation unit 12. The inkjet head 11 includes plural head modules 16.

Each of the head modules 16 has an ink chamber (not illustrated) that stores ink and plural nozzles (not illustrated) that eject ink. A piezo element (not illustrated) is disposed in the ink chamber. Ink is ejected through the nozzles by driving of the piezo element.

The ink circulation unit 12 supplies ink to the inkjet head 11 while circulating ink. The ink circulation unit 12 includes a positive pressure tank 21, an ink distributor 22, an ink collector 23, a negative pressure tank 24, an ink pump 25, an ink temperature regulator 26, an ink temperature sensor 27, and ink circulation pipes 28 to 30.

The positive pressure tank 21 stores ink to be supplied to the inkjet head 11. The ink in the positive pressure tank 21 is supplied to the inkjet head 11 via the ink circulation pipe 28 and the ink distributor 22. An air layer 31 is formed on the liquid level of the ink in the positive pressure tank 21. The positive pressure tank 21 communicates with the later-described positive pressure common air chamber 51 via the later-described positive-pressure-side communication pipes 52. It is to be noted that the air layer 31 constitutes part of the later-described positive pressure space 83 (see FIG. 3).

The positive pressure tank 21 is provided with a float member 32, a positive pressure tank liquid level sensor 33, and an ink filter 34.

One end of the float member 32 is pivotally supported by a support axle (not illustrated) in the positive pressure tank 21 so that the float member 32 rotates according to the liquid level height of the ink in the positive pressure tank 21 until the liquid level height reaches a reference height. The other end of the float member 32 is provided with a magnet (not illustrated).

The positive pressure tank liquid level sensor 33 is for determining whether or not the liquid level height of the ink in the positive pressure tank 21 has reached a reference height. The reference height is lower than the upper end of the positive pressure tank 21. The positive pressure tank liquid level sensor 33 includes a magnetic sensor and detects the magnet of the float member 32 when the liquid level height has reached the reference height. When the magnet of the float member 32 is detected, that is, when the liquid level height in the positive pressure tank 21 is greater than or equal to the reference height, the positive pressure tank liquid level sensor 33 outputs a signal that indicates "ON". When the magnet of the float member 32 is not detected, that is, when the liquid level height in the positive pressure tank 21 is less than the reference height, the positive pressure tank liquid level sensor 33 outputs a signal that indicates "OFF".

The ink filter 34 removes dirt and other in the ink.

The ink distributor 22 distributes the ink supplied from the pressure tank 21 to each head module 16 of the inkjet head 11 through the ink circulation pipe 28.

The ink collector 23 collects from each head module 16 the ink that has not been consumed by the inkjet head 11. The ink collected by the ink collector 23 flows to the negative pressure tank 24 through the ink circulation pipe 29.

The negative pressure tank 24 receives from the ink collector 23 and stores the ink that has not been consumed by the inkjet head 11. In addition, the negative pressure tank 24 stores the ink that is supplied from an ink cartridge 46 of the later-described ink supply unit 13. An air layer 36 is formed on the liquid level of the ink in the negative pressure tank 24. The negative pressure tank 24 communicates with the later-described negative pressure common air chamber 58 through the later-described negative-pressure-side communication pipe 59. The negative pressure tank 24 is disposed at the same height as the positive pressure tank 21. It is to be noted that the air layer 36 constitutes part of the later-described negative pressure space 84 (see FIG. 3).

The negative pressure tank 24 is provided with a float member 37 and a negative pressure tank liquid level sensor 38.

The float member 37 and the negative pressure tank liquid level sensor 38 are similar to the float member 32 and the pressure tank liquid level sensor 38 of the positive pressure tank 21. When the magnet of the float member 37 is detected, that is, when the liquid level height in the negative pressure tank 24 is greater than or equal to the reference height, the pressure tank liquid level sensor 38 outputs a signal that indicates "ON". When the magnet of the float member 37 is not detected, that is, when the liquid level height in the negative pressure tank 24 is less than the reference height, the pressure tank liquid level sensor 38 outputs a signal that indicates "OFF". The reference height is lower than the upper end of the negative pressure tank 24.

The ink pump 25 delivers ink from the negative pressure tank 24 to the positive pressure tank 21. The ink pump 25 is provided midway along the ink circulation pipe 30.

The ink temperature regulator 26 regulates the temperature of the ink in the ink circulation unit 12. The ink temperature regulator 26 is provided midway along the ink circulation pipe 28. The ink temperature regulator 26 includes a heater 41, a heater temperature sensor 42, a heat sink 43, and a cooling fan 44.

The heater 41 heats the ink in the ink circulation pipe 28. The heater temperature sensor 42 detects the temperature of the heater 41. The heat sink 43 cools the ink in the ink circulation pipe 28 by heat radiation. The cooling fan 44 delivers cooling air to the heat sink 43.

The ink temperature sensor 27 detects the temperature of the ink in the ink circulation unit 12. The ink temperature sensor 27 is provided midway along the ink circulation pipe 28.

The ink circulation pipe 28 connects the positive pressure tank 21 and the ink distributor 22. Part of the ink circulation pipe 28 is branched into a portion that passes through the heater 41 and a portion that passes through the heat sink 43. In the ink circulation pipe 28, ink flows from the positive pressure tank 21 to the ink distributor 22. The ink circulation pipe 29 connects the ink collector 23 and the negative pressure tank 24. In the ink circulation pipe 29, ink flows from the ink collector 23 to the negative pressure tank 24. The ink circulation pipe 30 connects the negative pressure tank 24 and the positive pressure tank 21. In the ink circulation pipe 30, ink flows from the negative pressure tank 24 to the positive pressure tank 21. The ink circulation pipes 28 to 30, the ink distributor 22, and the ink collector 23 constitute a circulation path for circulating ink between the positive pressure tank 21, the inkjet head 11, and the negative pressure tank 24.

The ink supply unit 13 supplies ink to the ink circulation unit 12. The ink supply unit 13 includes an ink cartridge 46, an ink supply valve 47, and an ink supply pipe 48.

The ink cartridge 46 stores ink to be used in printing by the inkjet head 11. The ink in the ink cartridge 46 is supplied to the negative pressure tank 24 of the ink circulation unit 12 through the ink supply pipe 48.

The ink supply valve 47 opens and closes the flow path of ink in the ink supply pipe 48. When ink is supplied to the negative pressure tank 24, the ink supply valve 47 is opened.

The ink supply pipe 48 connects the ink cartridge 46 and the negative pressure tank 24. In the ink supply pipe 48, ink flows from the ink cartridge 46 to the negative pressure tank 24.

The pressure generation unit 3 generates pressure for ink circulation to the positive pressure tank 21 and the negative pressure tank 24 of each printing unit 2. The pressure generation unit 3 includes a positive pressure common air chamber 51, four positive-pressure-side communication pipes 52, a positive-pressure-side air opening valve 53, a positive-pressure-side air opening pipe 54, a positive-pressure-side pressure regulation valve 55, a positive-pressure-side pressure regulation pipe 56, a positive-pressure-side pressure sensor 57, a negative pressure common air chamber 58, four negative-pressure-side communication pipes 59, a negative-pressure-side air opening valve 60, a negative-pressure-side air opening pipe 61, a negative-pressure-side pressure regulation valve 62, a negative-pressure-side pressure regulation pipe 63, a negative-pressure-side pressure sensor 64, an air pump 65, a pipe 66 for air pump, a junction pipe 67, an air filter 68, and an overflow pan 69.

The positive pressure common air chamber 51 is a chamber for equalizing the pressures of the positive pressure tanks 21 of the printing units 2. The positive pressure common air chamber 51 communicates with the air layers 31 of the positive pressure tanks 21 of the four printing units 2 through the four positive-pressure-side communication pipes 52. Thus, the pressure tanks 21 of the printing units 2 communicate with each other through the positive pressure common air chamber 51 and the positive-pressure-side communication pipes 52. The positive pressure common air chamber 51 constitutes part of the later-described positive pressure space 83.

The positive-pressure-side communication pipes 52 allow the positive pressure common air chamber 51 and the air layer 31 of the positive pressure tank 21 to communicate with each other. Each printing unit 2 is provided with a corresponding one of the four positive-pressure-side communication pipes 52. Each positive-pressure-side communication pipe 52 has one end connected to the positive pressure common air chamber 51 and the other end connected to the air layer 31 of a corresponding positive pressure tank 21. The positive-pressure-side communication pipe 52 constitutes part of the later-described positive pressure space 83.

The positive-pressure-side air opening valve 53 opens and closes the flow path of the air in the positive-pressure-side air opening pipe 54 for switching between a sealed state (sealed state from the atmosphere) and an air open state (open state to the atmosphere) of the positive pressure tank 21 through the positive pressure common air chamber 51. The positive-pressure-side air opening valve 53 is provided midway along the positive-pressure-side air opening pipe 54.

The positive-pressure-side air opening pipe 54 forms a flow path of air for opening the positive pressure tank 21 to the atmosphere through the positive pressure common air chamber 51. The positive-pressure-side air opening pipe 54 has one end connected to the positive pressure common air chamber 51 and the other end connected to the junction pipe 67. The portion between the positive pressure common air chamber 51 and the positive-pressure-side air opening valve 53 in the positive-pressure-side air opening pipe 54 constitutes part of the later-described positive pressure space 83. In addition, the portion between the positive-pressure-side air opening valve 53 and the junction pipe 67 in the positive-pressure-side air opening pipe 54 constitutes part of the later-described positive-pressure-side air opening path 81 (see FIG. 3).

The positive-pressure-side pressure regulation valve 55 opens and closes the flow path of the air in the positive-pressure-side pressure regulation pipe 56 in order to regulate the pressure of the positive pressure common air chamber 51 and the positive pressure tank 21. The positive-pressure-side pressure regulation valve 55 is provided midway along the positive-pressure-side pressure regulation pipe 56.

The positive-pressure-side pressure regulation pipe 56 forms a flow path of air for pressure regulation of the positive pressure common air chamber 51 and the positive pressure tank 21. The positive-pressure-side pressure regulation pipe 56 is formed of a pipe having a higher flow path resistance than that of the positive-pressure-side air opening pipe 54, the negative-pressure-side air opening pipe 61, and the junction pipe 67. Specifically, the positive-pressure-side pressure regulation pipe 56 is formed of a pipe narrower than the positive-pressure-side air opening pipe 54, the negative-pressure-side air opening pipe 61, and the junction pipe 67. The positive-pressure-side pressure regulation pipe 56 has one end connected to the positive pressure common air chamber 51 and the other end connected to the junction pipe 67. The portion between the positive pressure common air chamber 51 and the positive-pressure-side pressure regulation valve 55 in the positive-pressure-side pressure regulation pipe 56 constitutes part of the later-described positive pressure space 83.

The positive-pressure-side pressure sensor 57 detects the pressure of the positive pressure common air chamber 51. The pressure of the positive pressure common air chamber 51 is equal to the pressure of the positive pressure tank 21 of each printing unit 2. This is because the positive pressure common air chamber 51 communicates with the air layer 31 in the positive pressure tank 21 of each printing unit 2.

The negative pressure common air chamber 58 is an air chamber for equalizing the pressures of the negative pressure tank s24 of the printing units 2. The negative pressure common air chamber 58 communicates with the air layers 36 of the negative pressure tanks 24 of the four printing units 2 through the respective four negative-pressure-side communication pipes 59. Thus, the negative pressure tanks 24 of the printing units 2 communicate with each other through the negative pressure common air chamber 58 and the negative-pressure-side communication pipes 59. The negative pressure common air chamber 58 constitutes part of the later-described negative pressure space 84.

The negative-pressure-side communication pipes 59 allow the negative pressure common air chamber 58 and the air layer 36 of each negative pressure tank 24 to communicate with each other. Each printing unit 2 is provided with a corresponding one of the four negative-pressure-side communication pipes 59. Each negative-pressure-side communication pipe 59 has one end connected to the negative pressure common air chamber 58 and the other end connected to the air layer 36 of a corresponding negative pressure tank 24. The negative-pressure-side communication pipes 59 constitute part of the later-described negative pressure space 84.

The negative-pressure-side air opening valve 60 opens and closes the flow path of the air in the negative-pressure-side air opening pipe 61 for switching between a sealed state and an air opened state of the negative pressure tank 24 through the negative pressure common air chamber 58. The negative-pressure-side air opening valve 60 is provided midway along the negative-pressure-side air opening pipe 61.

The negative-pressure-side air opening pipe 61 forms a flow path of air for opening the negative pressure tank 24 to the atmosphere through the negative pressure common air chamber 58. The negative-pressure-side air opening pipe 61 has one end connected to the negative pressure common air chamber 58 and the other end connected to the junction pipe 67. The portion between the negative pressure common air chamber 58 and the negative-pressure-side air opening valve 60 in the negative-pressure-side air opening pipe 61 constitutes part of the later-described negative pressure space 84. The portion between the negative-pressure-side air opening valve 60 and the junction pipe 67 in the negative-pressure-side air opening pipe constitutes part of the later-described negative-pressure-side air opening path 82 (see FIG. 3).

The negative-pressure-side pressure regulation valve 62 opens and closes the flow path of the air in the negative-pressure-side pressure regulation pipe 63 in order to regulate the pressure of the negative pressure common air chamber 58 and the negative pressure tank 24. The negative-pressure-side pressure regulation valve 62 is provided midway along the negative-pressure-side pressure regulation pipe 63.

The negative-pressure-side pressure regulation pipe 63 forms a flow path of air for pressure regulation of the negative pressure common air chamber 58 and the negative pressure tank 24. The negative-pressure-side pressure regulation pipe 63 is formed of a pipe having a higher flow path resistance than that of the positive-pressure-side air opening pipe 54, the negative-pressure-side air opening pipe 61, and the junction pipe 67. Specifically, the negative-pressure-side pressure regulation pipe 63 is formed of a pipe narrower than the positive-pressure-side air opening pipe 54, the negative-pressure-side air opening pipe 61, and the junction pipe 67. The negative-pressure-side pressure regulation pipe 63 has one end connected to the negative pressure common air chamber 58 and the other end connected to the junction pipe 67. The portion between the negative pressure common air chamber 58 and the negative-pressure-side pressure regulation valve 62 in negative-pressure-side pressure regulation pipe 63 constitutes part of the later-described negative pressure space 84.

The negative-pressure-side pressure sensor 64 detects the pressure of the negative pressure common air chamber 58. The pressure of the negative pressure common air chamber 58 is equal to the pressure of the negative pressure tank 24 of each printing unit 2. This is because the negative pressure common air chamber 58 communicates with the air layer 36 of the negative pressure tank 24 of each printing unit 2.

The air pump 65 sucks air from the negative pressure tank 24 of each printing unit 2 through the negative pressure common air chamber 58 and delivers air to the positive pressure tank 21 of each printing unit 2 through the positive pressure common air chamber 51. The air pump 65 is provided midway along the pipe 66 for air pump.

The pipe 66 for air pump forms a flow path of air that is delivered from the negative pressure common air chamber 58 to the positive pressure common air chamber 51 by the air pump 65. The pipe 66 for air pump has one end connected to the positive pressure common air chamber 51 and the other end connected to the negative pressure common air chamber 58. The portion between the positive pressure common air chamber 51 and the air pump 65 in the pipe 66 for air pump constitutes part of the later-described positive pressure space 83. In addition, the portion between the negative pressure common air chamber 58 and the air pump 65 in the pipe 66 for air pump constitutes part of the later-described negative pressure space 84.

The junction pipe 67 has one end connected to the overflow pan 69 and the other end (upper end) communicating with the atmosphere via the air filter 68. At normal time, the end of the junction pipe 67, near the overflow pan 69 is closed by the later-described overflow ball 71. The junction pipe 67 is connected to the positive-pressure-side air opening pipe 54, the positive-pressure-side pressure regulation pipe 56, the negative-pressure-side air opening pipe 61, and the negative-pressure-side pressure regulation pipe 63. Thus, the positive-pressure-side air opening pipe 54, the positive-pressure-side pressure regulation pipe 56, the negative-pressure-side air opening pipe 61, and the negative-pressure-side pressure regulation pipe 63 each communicate with the atmosphere. Part of the junction pipe 67 constitutes part of the later-described positive-pressure-side air opening path 81. In addition, part of the junction pipe 67 constitutes part of the later-described negative-pressure-side air opening path 82.

The air filter 68 protects the junction pipe 67 against intrusion of dirt and other in the air. The air filter 68 is installed at the upper end of the junction pipe 67.

For instance, in the case where ink overflows from the positive pressure tank 21 and the negative pressure tank 24 and further overflows from the positive pressure common air chamber 51 and the negative pressure common air chamber 58 due to abnormality of the ink supply valve 47, the overflow pan 69 receives the overflown ink that flows through the junction pipe 67.

The overflow pan 69 is provided with an overflow ball 71. When there is no ink in the overflow pan 69, the overflow ball 71 closes the open end of the junction pipe 67, in the bottom of the overflow pan 69, thereby protecting the junction pipe 67 against inflow of air from the outside. When ink flows into the overflow pan 69 through the junction pipe 67, the overflow ball 71 floats and allows the ink to flow into the overflow pan 69.

In addition, the overflow pan 69 is provided with a float member 72 and an overflow liquid level sensor 73. The float member 72 and the overflow liquid level sensor 73 are similar to the float member 32 and the positive pressure tank liquid level sensor 33 of the positive pressure tank 21.

The overflow pan 69 is connected to a waste fluid tank (not illustrated), and when the overflow liquid level sensor 73 indicates ON, ink is discharged into the waste fluid tank.

The ambient temperature sensor 4 detects an ambient temperature in the inkjet printer 1.

The transfer unit 4 takes a sheet of paper from a paper feed tray (not illustrated) and transfers the sheet along a transfer path. The transfer unit 4 has a roller for transferring a sheet of paper and a motor for driving the roller (both not illustrated).

The controller 5 controls the operation of each component of the inkjet printer 1. The controller 5 includes a storage unit such as a CPU, a RAM, a ROM, and a hard disk. The controller 5 achieves the control (function) described below by executing a desirable program that is stored in the storage unit to be used in the present device.

The controller 6 causes the inkjet head 11 to eject ink and perform printing while performing an ink circulation operation. The ink circulation operation is to cause ink to be circulated along a circulation path by applying a positive pressure and a negative pressure to the positive pressure tank 21 and the negative pressure tank 24, respectively by the pressure generation unit 3 and controlling driving of the ink pump 25 according to the liquid levels of the positive pressure tank 21 and the negative pressure tank 24. When terminating the ink circulation operation, the controller 6 opens the positive-pressure-side air opening valve 53, then opens the negative-pressure-side air opening valve 60, and performs control to open the later-described positive pressure space 83 and the negative pressure space 84 to the atmosphere.

Figure 3:
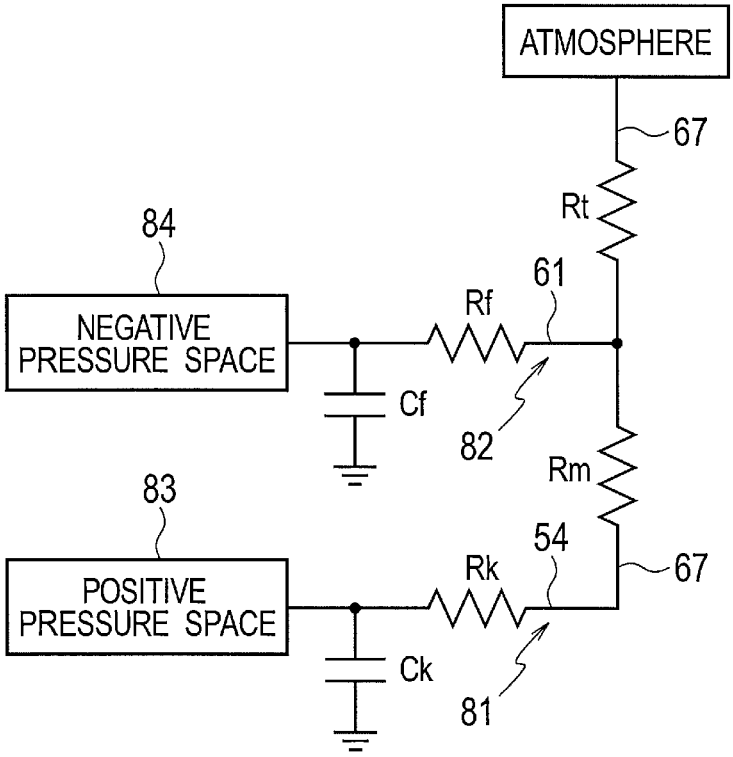
FIG. 3 is a fluidic circuit model diagram of an air open system in an inkjet printer illustrated in FIG. 1.

Next, the air path of the air open system of the inkjet printer 1 will be described. FIG. 3 is a fluidic circuit model diagram of the air open system in the inkjet printer 1.

As illustrated in FIG. 3, the air path of the air open system includes a positive-pressure-side air opening path 81 and a negative-pressure-side air opening path 82.

The positive-pressure-side air opening path 81 has one end connected to the later-described positive pressure space 83 and the other end communicating with the atmosphere. Specifically, the positive-pressure-side air opening path 81 includes the portion between the positive-pressure-side air opening valve 53 and the junction pipe 67 in the positive-pressure-side air opening pipe 54 illustrated in FIG. 2, the upper portion of the junction pipe 67 with respect to the junction point with the positive-pressure-side air opening pipe 54, and the air filter 68.

The negative-pressure-side air opening path 82 has one end connected to the later-described negative pressure space 84 and the other end communicating with the atmosphere. Specifically, the negative-pressure-side air opening path 82 includes the portion between the negative-pressure-side air opening valve 60 and the junction pipe 67 in the negative-pressure-side air opening pipe 61 illustrated in FIG. 2, the upper portion of the junction pipe 67 with respect to the junction point with the negative-pressure-side air opening pipe 61, and the air filter 68.

As seen from the FIG. 3 and the aforementioned description, the positive-pressure-side air opening path 81 and the negative-pressure-side air opening path 82 are connected and communicate each other so as to share the air filter 68 and part of the junction pipe 67 including the upper end.

The positive pressure space 83 is a portion to which a positive pressure is applied for circulating ink along the circulation path of the ink circulation unit 12. Specifically, the positive pressure space 83 includes the air layer 31 of the positive pressure tank 21 illustrated in FIG. 2, the positive pressure common air chamber 51, the positive-pressure-side communication pipes 52, the portion between the positive pressure common air chamber 51 and the positive-pressure-side air opening valve 53 in the positive-pressure-side air opening pipe 54, the portion between the positive pressure common air chamber 51 and the positive-pressure-side pressure regulation valve 55 in the positive-pressure-side pressure regulation pipe 56, and the portion between the positive pressure common air chamber 51 and the air pump 65 in the pipe 66 for air pump. The positive pressure space 83 is opened or closed to the positive-pressure-side air opening path 81 by opening or closing the positive-pressure-side air opening valve 53.

The negative pressure space 84 is a portion to which a negative pressure is applied for circulating ink along the circulation path of the ink circulation unit 12. Specifically, the negative pressure space 84 includes the air layer 36 of the negative pressure tank 24 illustrated in FIG. 2, the negative pressure common air chamber 58, the negative-pressure-side communication pipes 59, the portion between the negative pressure common air chamber 58 and the negative-pressure-side air opening valve 60 in the negative-pressure-side air opening pipe 61, the portion between the negative pressure common air chamber 58 and the negative-pressure-side pressure regulation valve 62 in the negative-pressure-side pressure regulation pipe 63, and the portion between the negative pressure common air chamber 58 and the air pump 65 in the pipe 66 for air pump. The negative pressure space 84 is opened or closed to the negative-pressure-side air opening path 82 by opening or closing the negative-pressure-side air opening valve 60.

Rk in FIG. 3 is the flow path resistance of the portion between the positive-pressure-side air opening valve 53 and the junction pipe 67 in the positive-pressure-side air opening pipe 54. Rf is the flow path resistance of the portion between the negative-pressure-side air opening valve 60 and the junction pipe 67 in the negative-pressure-side air opening pipe 61. Rm is the flow path resistance of the portion between the junction point of the junction pipe 67 with the positive-pressure-side air opening pipe 54 and the junction point of the junction pipe 67 with the negative-pressure-side air opening pipe 61. Rt is the flow path resistance of the air filter 68 and the upper portion of the junction pipe 67 with respect to the junction point with the negative-pressure-side air opening pipe 61.

Ck in FIG. 3 is the air capacity of the positive pressure space 83. The air capacity Ck of the positive pressure space 83 is the sum of the air capacities of the components included in the positive pressure space 83. Here, the air capacity of the air layer 31 of the positive pressure tank 21 corresponds the volume of the portion in the positive pressure tank 21, higher than or equal to a reference height of ink liquid level. Cf in FIG. 3 is the air capacity of the negative pressure space 84. The air capacity Cf of the negative pressure space 84 is the sum of the air capacities of the components included in the negative pressure space 84. Here, the air capacity of the air layer 36 of the negative pressure tank 21 corresponds the volume of the portion in the negative pressure tank 24, higher than or equal to a reference height of ink liquid level.

As described above, when terminating an ink circulation operation, the controller 6 opens the positive-pressure-side air opening valve 53, and then opens the negative-pressure-side air opening valve 60. When the positive-pressure-side air opening valve 53 is opened, air flows out from the positive pressure space and air escapes to the outside through the positive-pressure-side air opening path 81. Subsequently, when the negative-pressure-side air opening valve 60 is opened, air initially moves from the positive pressure space 83 to the negative pressure space 84 mainly through the positive-pressure-side air opening pipe 54, the junction pipe 67, and the negative-pressure-side air opening pipe 61. Subsequently, the positive pressure space 83 and the negative pressure space 84 are opened to the atmosphere due to movement of air through an upper portion of the junction pipe 67 and the air filter 68.

In the process of opening to the atmosphere, a change in the pressure of the positive pressure space 83 during the period from the opening of the positive-pressure-side air opening valve 53 to the opening of the negative-pressure-side air opening valve 60 is the same as a change in the pressure of the positive pressure space 83 in a state where the positive-pressure-side air opening valve 53 is opened to open only the positive pressure space 83 to the atmosphere with the negative-pressure-side air opening valve 60 closed. After the opening of the positive-pressure-side air opening valve 53, the pressure Pk of the positive pressure space 83 varies exponentially. That is, the pressure Pk of the positive pressure space 83 during the period from the opening of the positive-pressure-side air opening valve 53 to the opening of the negative-pressure-side air opening valve 60 is expressed by the following Expression (1).

$$Pk=Pk0\times\exp(-t/\tau k) \quad (1)$$

Pk0 is the setting pressure on the positive pressure side during ink circulation. t is the time elapsed since the opening of the positive-pressure-side air opening valve 53. τk is a time constant according to flow path resistance Ra of the positive-pressure-side air opening path 81 and the air capacity Ck of the positive pressure space 83. The time constant tk is expressed by the following Expression (2).

$$\tau k=Ra\times Ck \quad (2)$$

The flow path resistance Ra of the positive-pressure-side air opening path 81 is expressed by the following Expression (3).

$$Ra=Rk+Rm+Rt \quad (3)$$

Based on the time constant τk, the controller 6 determines time Td since the opening of the positive-pressure-side air opening valve 53 until the negative-pressure-side air opening valve 60 is opened so that nozzle pressure Pn of the inkjet head 11 does not exceed meniscus breakage pressure Pn_max.

Here, the flow path resistance varies according to the viscosity of air. The viscosity of air varies according to the temperature. Therefore, the time constant τk varies according to the ambient temperature.

The nozzle pressure Pn is determined by the pressure Pk of the positive pressure space 83 and the pressure Pf of the negative pressure space 84, and is expressed by the following Expression (4).

$$Pn=(Pk+Pf)/2 \quad (4)$$

The meniscus breakage pressure Pn_max is determined by the diameter of a nozzle and the surface tension of ink.

Next, the operation of the inkjet printer 1 will be described.

Figure 4:
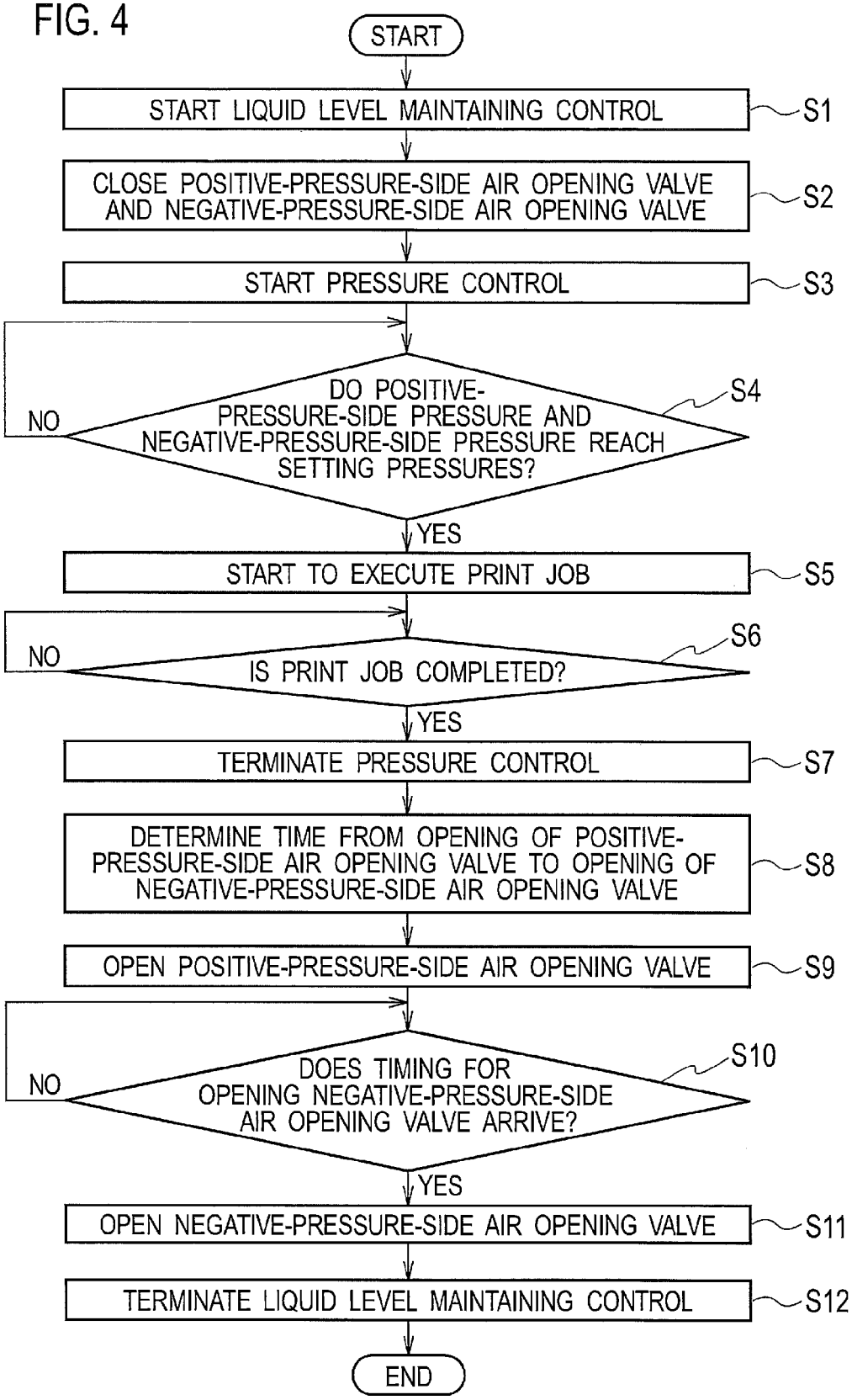
FIG. 4 is a flow chart for explaining the operation of the inkjet printer illustrated in FIG. 1.

FIG. 4 is a flow chart for explaining the operation of the inkjet printer 1. The processing of the flow chart of FIG. 4 is started by inputting a print job to the inkjet printer 1.

In step S1 of FIG. 4, the controller 6 starts liquid level maintaining control. The liquid level maintaining control is the control of the ink pump 25 and the ink supply valve 47 according to the liquid levels of the positive pressure tank 21 and the negative pressure tank 24 in order to maintain the liquid level at the reference height.

Figures 5, 6:
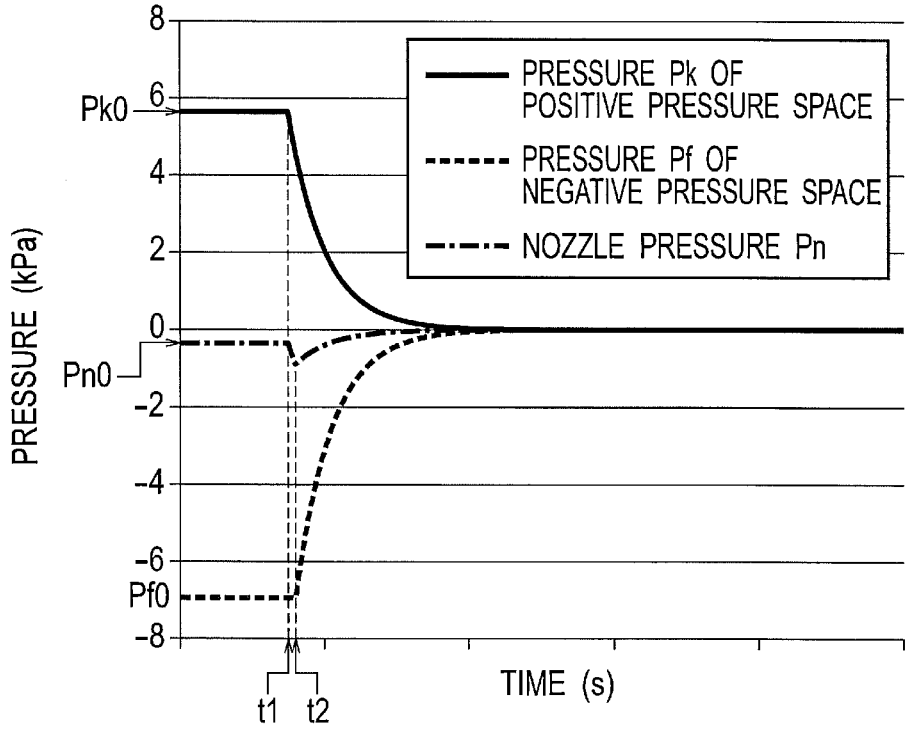
FIG. 5 is an explanatory table for liquid level maintaining control.
FIG. 6 is a graph illustrating an example of transition of the pressure of a positive pressure space, the pressure of a negative pressure space, and a nozzle pressure when a positive-pressure-side air opening valve is opened then a negative-pressure-side air opening valve is opened.

Specifically, as illustrated in FIG. 5, in a state where both the positive pressure tank liquid level sensor 33 and the negative pressure tank liquid level sensor 38 indicate ON, the controller 6 turns off the ink pump 25 to close the ink supply valve 47. Similarly, in a state where the positive pressure tank liquid level sensor 33 indicates ON and the negative pressure tank liquid level sensor 38 indicates OFF, the controller 6 turns off the ink pump 25 to close the ink supply valve 47.

In a state where the positive pressure tank liquid level sensor 33 indicates OFF and the negative pressure tank liquid level sensor 38 indicates ON, the controller 6 turns on the ink pump 25 to close the ink supply valve 47.

In a state where both the positive pressure tank liquid level sensor 33 and the negative pressure tank liquid level sensor 38 indicate OFF, the controller 6 turns off the ink pump 25 to open the ink supply valve 47.

Returning to FIG. 4, in step S2 subsequent to step S1, the controller 6 closes the positive-pressure-side air opening valve 53 and the negative-pressure-side air opening valve 60. Thus, the positive pressure space 83 and the negative pressure space 84 illustrated in FIG. 3 each assume a sealed state. That is, the positive pressure tank 21 of each printing unit 2 illustrated in FIG. 2 assumes a sealed state via the positive pressure common air chamber 51, and the negative pressure tank 24 of each printing unit 2 assumes a sealed state via the negative pressure common air chamber 58. Here, during standby in which the inkjet printer 1 is not in operation, the positive-pressure-side air opening valve 53 and the negative-pressure-side air opening valve 60 are opened, and the positive-pressure-side pressure regulation valve 55 and the negative-pressure-side pressure regulation valve 62 are closed. It is to be noted that after the closing of the positive-pressure-side air opening valve 53 and the negative-pressure-side air opening valve 60 in step S2, the liquid level maintaining control may be started.

Subsequently, in step S3, the controller 6 starts pressure control. The pressure control includes applying a positive setting pressure Pk0 and a negative setting pressure Pf0 to the positive pressure tank 21 and the negative pressure tank 24, respectively and controlling the air pump 65, the positive-pressure-side pressure regulation valve 55, and the negative-pressure-side pressure regulation valve 62 in order to maintain the setting pressures.

Specifically, the controller 6, when starting the pressure control, activates the air pump 65. Thus, air is delivered from the negative pressure common air chamber 58 to the positive pressure common air chamber 51, thereby decompressing the negative pressure space 84 and pressurizing the positive pressure space 83. In this manner, ink flows from the positive pressure tank 21 to the inkjet head 11.

When the pressure (positive-pressure-side pressure) of the positive pressure space 83 detected by the positive-pressure-side pressure sensor 57 and the pressure (negative-pressure-side pressure) of the negative pressure space 84 detected by the negative-pressure-side pressure sensor 64 reach to the respective setting pressures Pk0 and Pf0, the controller 6 stops the air pump 65. The setting pressures Pk0, Pf0 are predetermined values of the pressure that sets the nozzle pressure Pn of the inkjet head 11 to an appropriate value (negative pressure) while causing circulation of ink. In order to set the positive-pressure-side pressure and the negative-pressure-side pressure to the respective setting pressures Pk0 and Pf0, the controller 6 controls opening and closing of the positive-pressure-side pressure regulation valve 55 and the negative-pressure-side pressure regulation valve 62 to regulate the positive-pressure-side pressure and the negative-pressure-side pressure according to the values detected by the positive-pressure-side pressure sensor 57 and the negative-pressure-side pressure sensor 64.

After the pressure control is started, even after once the positive-pressure-side pressure and the negative-pressure-side pressure reach to the respective setting pressures Pk0 and Pf0, the controller drives the air pump 65, and opens and closes the positive-pressure-side pressure regulation valve 55 and the negative-pressure-side pressure regulation valve 62 to maintain the setting pressures, according to the values detected by the positive-pressure-side pressure sensor 57 and the negative-pressure-side pressure sensor 64.

After the start of the pressure control, in step S4, the controller 6 determines whether or not the positive-pressure-side pressure and the negative-pressure-side pressure reach the respective setting pressures Pk0 and Pf0. When it is determined that the positive-pressure-side pressure and the negative-pressure-side pressure do not reach the respective setting pressures Pk0 and Pf0 (No in step S4) yet, the controller 6 repeats step S4.

When it is determined that the positive-pressure-side pressure and the negative-pressure-side pressure reach the respective setting pressures Pk0 and Pf0 (Yes in step S4), the controller 6 starts to execute a print job in step S5. Specifically, the controller 6 ejects ink from the inkjet head 11 and prints an image on a sheet of paper transferred by the transfer unit 5, based on the print job.

During execution of the print job, ink is supplied from the positive pressure tank 21 to the inkjet head 11, and the ink, which is not consumed by the inkjet head 11, is collected by the negative pressure tank 24. When the positive pressure tank liquid level sensor 33 indicates OFF and the negative pressure tank liquid level sensor 38 indicates ON, the liquid level maintaining control causes the ink pump 25 to deliver ink from the negative pressure tank 24 to the positive pressure tank 21. In this manner, printing is performed while ink is circulated.

During the circulation of ink, the controller 6 controls the ink temperature regulator 26 to regulate the ink temperature so that the temperature detected by the ink temperature sensor 27 is maintained in an appropriate temperature range.

After the print job execution is started, in step S6, the controller 6 determines whether or not the print job is completed. When it is determined that the print job is not completed (NO in step S6), the controller 6 repeats step S6.

When it is determined that the print job is completed (YES in step S6), in step S7, the controller 6 terminates the pressure control. Here, when the air pump 65 is being driven, the controller 6 stops the air pump 65. When the positive-pressure-side pressure regulation valve 55 and the negative-pressure-side pressure regulation valve 62 are open, the controller 6 closes the valves.

Subsequently, in step S8, the controller 6 determines time Td from opening of the positive-pressure-side air opening valve 53 to opening of the negative-pressure-side air opening valve 60.

Specifically, first, the controller 6 obtains an ambient temperature from the ambient temperature sensor 4. Subsequently, the controller 6 calculates a viscosity of air according to the obtained ambient temperature. Here, the controller 6 pre-stores a calculation formula for determining a viscosity according to the temperature of air. The controller 6 calculates a viscosity of air based on the formula according to the ambient temperature detected by the ambient temperature sensor 4.

Subsequently, the controller 6 calculates flow path resistance Ra of the positive-pressure-side air opening path 81 according to the calculated viscosity of air. Here, the controller 6 pre-stores a theoretical value of proportionality constant (flow path resistance/viscosity) between the flow path resistance Ra of the positive-pressure-side air opening path 81 and the viscosity of air. The controller 6 calculates the flow path resistance Ra of the positive-pressure-side air opening path 81 based on the theoretical value of proportionality constant and the viscosity of air according to the ambient temperature.

Subsequently, the controller 6 calculates a time constant τk according to the flow path resistance Ra. The controller 6 then determines time Td based on the calculated time constant τk so that the nozzle pressure Pn does not exceed the meniscus breakage pressure Pn_max.

Here, the pressure of the negative pressure space 84 is at the setting pressure Pf0 during the period from opening of the positive-pressure-side air opening valve 53 to opening of the negative-pressure-side air opening valve 60. Thus, the nozzle pressure Pn during the period is denoted by the expression obtained by substituting Pf=Pf0 into Expression (4). Therefore, the condition that the nozzle pressure Pn does not exceed the meniscus breakage pressure Pn_max during the period is given by the following Expression (5).

$$|(Pk+Pf0)/2|<Pn_\max \tag{5}$$

Therefore, the controller 6 determines time Td so that the following Expression (6) is satisfied.

$$|(Pk0\times\exp(-Td/\tau k)+Pf0)/2|<Pn_\max \tag{6}$$

Subsequently, in step S9, the controller 6 opens the positive-pressure-side air opening valve 53. Thus, air starts to flow out from the positive pressure space 83 through the positive-pressure-side air opening path 81 and the pressure Pk of the positive pressure space 83 starts to decrease.

Subsequently, in step S10, the controller 6 determines whether or not timing for opening the negative-pressure-side air opening valve 60 arrives. When the time Td calculated in step S8 has elapsed since the opening of the positive-pressure-side air opening valve 53, the controller 6 determines that the timing for opening the negative-pressure-side air opening valve 60 arrives. When it is determined that the timing for opening the negative-pressure-side air opening valve 60 does not arrive yet (NO in step S10), the controller 6 repeats step S10.

When it is determined that the timing for opening the negative-pressure-side air opening valve 60 arrives (YES in step S10), the controller 6 opens the negative-pressure-side air opening valve 60 in step S11. Thus, the positive pressure space 83 and the negative pressure space 84 are opened to the atmosphere. That is, the positive pressure tank 21 of each printing unit 2 in FIG. 2 is opened to the atmosphere through the positive pressure common air chamber 51 and others, and the negative pressure tank 24 of each printing unit 2 is opened to the atmosphere through the negative pressure common air chamber 58 and others.

Subsequently, in step S12, the controller 6 terminates the liquid level maintaining control. Thus, the ink circulation operation is terminated and the inkjet printer 1 is set in a standby state. It is to be noted that the ink circulation operation may be terminated before the opening of the positive-pressure-side air opening valve 53 in step S9.

Next, the transition of the nozzle pressure Pn after the opening of the positive-pressure-side air opening valve 53 in step S9 of FIG. 4 will be described.

FIG. 6 is a graph illustrating an example of transition of the pressure Pk of the positive pressure space 83, the pressure Pf of the negative pressure space 84, and the nozzle pressure Pn in the process of opening the pressure spaces to the atmosphere. It is to be noted that each pressure is expressed in terms of gauge pressure.

When the positive-pressure-side air opening valve 53 is opened at time t1, the pressure Pk of the positive pressure space 83 starts to decrease with the pressure Pf of the negative pressure space 84 maintained at the setting pressure Pf0. Consequently, the nozzle pressure Pn decreases from the nozzle pressure Pn0 which is a negative pressure during circulation of ink.

Subsequently, when the negative-pressure-side air opening valve 60 is opened at time t2, the pressure Pf of the negative pressure space 84 starts to increase. Subsequently, the pressure Pk of the positive pressure space 83 and the pressure Pf of the negative pressure space 84 change to the atmospheric pressure (0 kPa), and the positive pressure space 83 and the negative pressure space 84 are opened to the atmosphere. Accordingly, the nozzle pressure Pn also changes to the atmospheric pressure.

Figure 7:
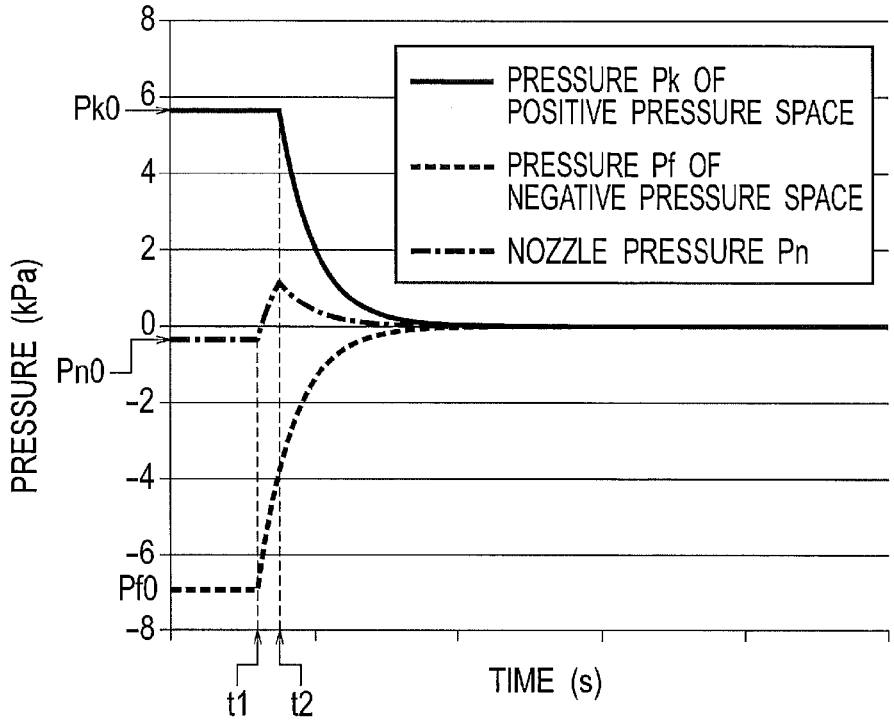
FIG. 7 is a graph illustrating an example of transition of the pressure of the positive pressure space, the pressure of the negative pressure space, and the nozzle pressure when the negative-pressure-side air opening valve is opened then the positive-pressure-side air opening valve is opened.

In contrast to the present embodiment, if the negative-pressure-side air opening valve 60 is opened before the positive-pressure-side air opening valve 53 is opened, the nozzle pressure Pn increases and may reach a positive pressure as illustrated in FIG. 7. When the nozzle pressure Pn reaches a positive pressure and exceeds the meniscus breakage pressure Pn_max, leakage of ink through a nozzle occurs. When leakage of ink occurs, ink is wasted and contamination in the device is caused.

In contrast to this, in the present embodiment, as described above, the positive-pressure-side air opening valve 53 is opened before the opening of the negative-pressure-side air opening valve 60 and the nozzle pressure Pn is set to a negative pressure, thereby avoiding leakage of ink through a nozzle.

Figure 8:
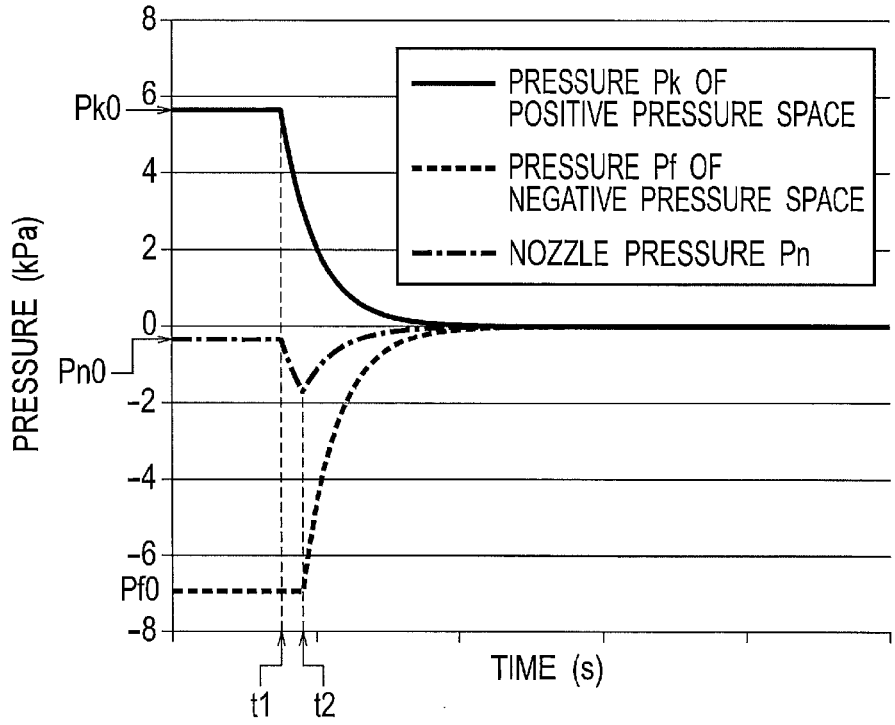
FIG. 8 is a graph illustrating an example of transition of the pressure of the positive pressure space, the pressure of the negative pressure space, and the nozzle pressure when the positive-pressure-side air opening valve is opened then the negative-pressure-side air opening valve is opened.

Next, FIG. 8 illustrates an example of transition of the pressure Pk of the positive pressure space 83, the pressure Pf of the negative pressure space 84, and the nozzle pressure Pn in the process of opening the pressure spaces to the atmosphere, in the case where the time constant τk is the same as in the example of FIG. 6 and the time Td from opening of the positive-pressure-side air opening valve 53 to opening of the negative-pressure-side air opening valve 60 is increased from that in the example of FIG. 6. In this case, in contrast to the example of FIG. 6, the amount of reduction in the pressure Pk of the positive pressure space 83 during the time (corresponding to the time Td) from time t1 to time t2 increases. Therefore, the amount of reduction in the nozzle pressure Pn during the time also increases. When the nozzle pressure Pn decreases too much, the magnitude of the negative pressure may exceed the meniscus breakage pressure Pn_max to break the meniscus and air may be sucked through a nozzle.

When the ambient temperature rises and the time constant τk is decreased, the amount of reduction in the pressure Pk of the positive pressure space 83 increases during the time Td from opening of the positive-pressure-side air opening valve 53 to opening of the negative-pressure-side air opening valve 60 even with the time Td unchanged. Therefore, the amount of reduction in the nozzle pressure Pn during the time also increases, and the nozzle pressure Pn may exceed the meniscus breakage pressure Pn_max.

Thus, in the inkjet printer 1, the time Td from opening of the positive-pressure-side air opening valve 53 to opening of the negative-pressure-side air opening valve 60 is determined based on the time constant τk so that the nozzle pressure Pn does not exceed the meniscus breakage pressure Pn_max.

As described above, in the inkjet printer 1, when terminating circulation of ink, the controller 6 opens the positive-pressure-side air opening valve 53, and then opens the negative-pressure-side air opening valve 60. Thus, leakage of ink through a nozzle can be reduced by setting the nozzle pressure Pn with the positive pressure space 83 and the negative pressure space 84 open to the atmosphere, to a negative pressure.

Also, the controller 6 determines the time Td from opening of the positive-pressure-side air opening valve 53 to opening of the negative-pressure-side air opening valve 60 based on the flow path resistance Ra of the positive-pressure-side air opening path 81 and the air capacity Ck of the positive pressure space 83. Thus, it is possible to avoid a situation in which excessive decrease in the nozzle pressure Pn causes meniscus to be broken and air to be sucked through a nozzle.

In the aforementioned embodiment, the configuration has been presented in which the positive-pressure-side air opening path 81 and the negative-pressure-side air opening path 82 are connected and partially shared. However, a configuration may be adopted in which the positive-pressure-side air opening path and the negative-pressure-side air opening path are not connected and independent.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

a printing unit with a circulation path and an inkjet head, the printing unit being configured to eject ink through a nozzle of the inkjet head while circulating the ink along the circulation path;

a positive pressure space for a positive pressure for circulating the ink along the circulation path to be applied;

a negative pressure space for a negative pressure for circulating the ink along the circulation path to be applied;

a positive-pressure-side air opening path having one end connected to the positive pressure space and another end communicating with atmosphere;

a negative-pressure-side air opening path having one end connected to the negative pressure space and another end communicating with the atmosphere;

a positive-pressure-side air opening valve configured to selectively open and close the positive pressure space to the positive-pressure-side air opening path;

a negative-pressure-side air opening valve configured to selectively open and close the negative pressure space to the negative-pressure-side air opening path; and a controller configured to, when terminating circulation of the ink in the circulation path, drive the positive-pressure-side air opening valve to open the positive pressure space to the positive-pressure-side air opening path and then drive the negative-pressure-side air opening valve to open the negative pressure space to the negative-pressure-side air opening path, thereby opening the positive pressure space and the negative pressure space to the atmosphere, wherein the controller is configured to determine a time from an opening of the positive-pressure-side air opening valve that opens the positive pressure space to the positive-pressure-side air opening path to an opening of the negative-pressure-side air opening valve that opens the negative pressure space to the negative-pressure-side air opening path, based on a time constant according to a flow path resistance of the positive-pressure-side air opening path and an air capacity of the positive pressure space.

2. The inkjet printer according to claim 1, wherein the controller is configured to:

calculate the time constant according to the flow path resistance; and determine the time based on the calculated time constant so that a nozzle pressure at the nozzle does not exceed a meniscus breakage pressure.

3. The inkjet printer according to claim 1, wherein the controller is configured to determine the time so that the following expression is satisfied:

$$|(Pk0\times\exp(-Td/\tau k)+Pf0)/2|<Pn_\max$$

where Td represents the time, τk represents the time constant, Pk0 represents a setting pressure in the positive pressure space during ink circulation, Pf0 represents a setting pressure in the negative pressure space during ink circulation, and Pn_max represents a meniscus breakage pressure at the nozzle.

4. The inkjet printer according to claim 1, wherein a nozzle pressure of the nozzle of the inkjet head is negative prior to driving the positive-pressure-side air opening valve to open the positive pressure space to the positive-pressure-side air opening valve to open the positive pressure space to the positive-pressure-side air opening path upon terminating circulation of the ink in the circulation path.

5. The inkjet printer according to claim 1, wherein when circulation of the ink in the circulation path is terminated, the positive-pressure-side air opening valve opens the positive pressure space to the positive-pressure-side air opening path before the negative-pressure-side air opening valve opens the negative pressure space to the negative-pressure-side air opening path.

6. The inkjet printer according to claim 1, wherein the determined time is time elapsed between the opening of the positive pressure space to the positive-pressure-side air opening path and the opening of the negative pressure space to the negative-pressure-side air opening path.

* * * * *